US007552957B2

(12) United States Patent
Bowes

(10) Patent No.: US 7,552,957 B2
(45) Date of Patent: Jun. 30, 2009

(54) HAND-HELD ANIMAL EXCREMENT REMOVAL DEVICE

(76) Inventor: Joseth Bowes, 6 Clennon Rise, Paignton, Devon (GB) TQ4 7NE ( * ) Notice: Subject to any disclaimer, the term of this patent is extended or adjusted under 35 U.S.C. 154(b) by 29 days.

(21) Appl. No.: 11/813,616

(22) PCT Filed: Nov. 30, 2005

(86) PCT No.: PCT/GB2005/004566

§ 371 (c)(1),
(2), (4) Date: Jul. 10, 2007

(87) PCT Pub. No.: WO2006/079770

PCT Pub. Date: Aug. 3, 2006

(65) Prior Publication Data

US 2008/0061569 A1 Mar. 13, 2008

(30) Foreign Application Priority Data

Jan. 27, 2005 (EP) ..... 0501701

(51) Int. Cl.
*A01K 29/00* (2006.01)
*E01H 1/12* (2006.01)

(52) U.S. Cl. ..... 294/1.3; 294/100

(58) Field of Classification Search ..... 294/1.3, 294/1.4, 1.5, 100
See application file for complete search history.

(56) References Cited

U.S. PATENT DOCUMENTS 4,852,242 A * 8/1989 Tella et al. ..... 294/86.4
5,775,755 A * 7/1998 Covert et al. ..... 294/100
6,106,042 A * 8/2000 McCloy, Jr. ..... 294/100
6,196,601 B1 3/2001 Juntunen, Jr.
6,315,340 B1 * 11/2001 Chen ..... 294/100

FOREIGN PATENT DOCUMENTS

| | | | |
|---|---|---|---|
| DE | 29601633 | U1 | 4/1996 |
| EP | 510472 | A2 | 10/1992 |
| EP | 561093 | A1 | 9/1993 |
| GB | 2227645 | A | 8/1990 |
| GB | 2236271 | A | 4/1991 |
| GB | 2255492 | A | 11/1992 |
| GB | 2381184 | A | 4/2003 |
| WO | WO 93/09971 | * | 5/1993 |
| WO | 9517810 | A1 | 7/1995 |

* cited by examiner

*Primary Examiner*—Paul T Chin
(74) *Attorney, Agent, or Firm*—David A. Guerra

(57) ABSTRACT

A device for removing animal excrement from a surface. The device has a cylindrical member, and a hollow outer member. The cylindrical member acts as a handle, one end of which terminates in a collar to which is attached a plurality of outwardly-biased gripping members. The hollow outer member is adapted to move over a tubular portion of the handle from a first position in which the gripping members are enclosed within the outer member to a second position in which the gripping members are exposed to enable them to deploy for use. A compression spring incorporated in the tubular portion of the handle is adapted to bear on the outer member to urge the outer member from the position at which the gripping members are exposed to that at which they are enclosed within the outer member.

20 Claims, 2 Drawing Sheets

HAND-HELD ANIMAL EXCREMENT REMOVAL DEVICE

CROSS-REFERENCE TO RELATED APPLICATIONS

This application is an U.S. national phase application under 35 U.S.C. §371 based upon co-pending International Application No. PCT/GB2005/004566 filed on Nov. 30, 2005. Additionally, this U.S. national phase application claims the benefit of priority of co-pending International Application No. PCT/GB2005/004566 filed on Nov. 30, 2005 and Great Britain Application No. 0501701.7 filed on Jan. 27, 2005. The entire disclosures of the prior applications are incorporated herein by reference. The international application was published on Aug. 3, 2006 under Publication No. WO 2006/079770 A1.

BACKGROUND OF THE INVENTION

1. Field of the Invention

The present invention relates to a device for removing deposited animal excrement from a surface.

2. Description of the Prior Art

Concern over the health risks and general unpleasantness occasioned by canine excrement in particular has led to the development of a number of devices for the removal of canine excrement form the surfaces of public places. Examples of such devices are shown in patent specifications GB 2,225,492; 2,236,271; 2,227,645; EPO 561 093 and WO 95/17810.

Specification GB 2,255,492 discloses a device in the form of a hollow walking stick in which there is a spring-loaded piston to which are attached a number of claws. The piston rod projects from the top of the walking stick and terminates in a handle. In use, the handle is pushed downwards to cause the claws to project from the bottom of the walking stick and to compress a spring and the claws are placed around a deposit of excrement to be removed. When the spring is released by means of a trigger within the handle, the piston is withdrawn into the body of the walking stick causing the claws to close around the excrement and draw it into the body of the walking stick assisted by the suction created by a piston seal. The device is cumbersome and not aesthetically pleasing.

Specification GB 2,236,291 discloses a device in which an inner tubular member terminates in an array of spring fingers which are biased outwardly but held in a closed configuration by an outer tubular member which can be moved upwardly to release the fingers to an open configuration, enabling them to be placed around a deposit of excrement and then downwardly to close around the excrement. Although the device may achieve its purpose, the components have to be moved manually.

Specification GB 2,227,645 A discloses a device in which a scoop has a lower blade and a movable upper blade forming a pair of tongs. The tongs are used in conjunction with a plastics bag which is placed around the tongs in such a way that there is a re-entrant portion of the plastics bag between the tongs. In use, the lower blade of the tongs is slid under a deposit of excrement until it is within the bag whereupon the tongs are closed to hold the excrement within the bag while it is slid off the tongs and enclosed within the bag.

Again, the device may be effective but it is cumbersome.

Specification EPO 561093 discloses a device which is very similar to that disclosed in GB 2,225,492 and similar remarks apply.

Specifications WO 95/17810 discloses a device which consists of a scoop mounted on a handle. The scoop is closed by a cover which can be moved forward by a linkage attached to the handle so that the device can be placed with the scoop on one side of a deposit of excrement and the cover on the other and the linkage operated to move the cover towards the scoop so sweeping the excrement into the scoop so sweeping the excrement into the scoops. The handle also acts as a reservoir for a liquid bactericide which can be discharged over the area from which the excrement has been removed.

EPO 510 472 A1 discloses an arrangement in which there are two tubular members, one of which can move within the other. Within the inner tube is housed, movably, a gripping member which includes a plurality of outwardly-biased claws. A coil-spring is included which acts to urge the inner of the two tubular members outwards. In use, initially the gripping member is pushed into the inner tubular member and that the inner tubular member is pushed into the outer member, so compressing the coil spring, and retained therein by means of a latch. To operate the device, the gripping member is withdraw from the inner tubular member, a plastics bag is placed over the free ends of the claws, the claws and the plastics bag are placed over excrement it is desired to remove from a surface and the latch is released. The spring urges the inner tubular member over the gripping member so causing the claws of the gripping member to close around the excrement and enclose it within the inner tubular member for later disposal.

A disadvantage of this device is that the gripping member has to be withdrawn manually from the outer member to deploy the gripping member when the gripping member. Also, when the gripping member is placed over the excrement, there is a tendency for the gripping member to move back into the inner tubular member.

Our earlier patent application GB0122664.6 discloses a device which has two tubular members, one of which can move within the other. A coil spring contained within the outer tubular member acts to expel the inner tubular member from the outer tubular member. The coil springs surround an axial core, to the free end of which there are attached three outwardly-biased claws of a length such that when the inner member is extended from the outer member, the claws are contained within the inner member. To use the device, the inner tubular member is pushed into the outer tubby member, so exposing the claws and enabling then to deploy themselves. At the same time the coil spring is compressed and a latch is engaged to retain the inner tubular with the outer tubular member. A plastics bag is then placed over the free ends of the claws and the bag and claws are placed over excrement to be removed from a surface, as in the device of EP 0510 472 A2, the latch is released, the inner tubular member is extended from the outer tubular member, causing the claws to close around the excrement so that it can be lifted from the surface and contained within the extended inner tubular member for later disposal.

This device overcomes the disadvantages of that of EP 0510 472 A2 because the deployment of the claws takes place automatically when the inner tubular member is pushed into the outer tubular member and there is no tendency for the claws to move back into the outer tubular member when they are placed around the excrement.

However, unless the diameter of the outer tubular member is relatively large, the volume of excrement which can be lifted by the device is limited—the same is true of the device of EP 0510 472 A2.

Specification U.S. Pat. No. 4,819,877 and GB 2,236,271 A both disclose devices in which an outer tube is moved over an inner tube both to deploy and enclose fingers which can be placed over animal feces so as to enable it to be removed from a surface.

However, in both cases, the outer tube is cylindrical and has to be moved manually both to deploy and enclose the fingers. Thus, these devices also are restricted in terms of the volume of feces they can remove. Also, the manual movement of the outer tube is a disadvantage, because it can cause the grabs to move in relation to the feces, makes the use of the devices cumbersome, because the use of two hands is necessary to operate the devices, and could cause an element of unpleasantness to sensitive people.

It is an object of the present invention to provide an improved device for removing animal excrement from a surface.

SUMMARY OF THE INVENTION

According to the present invention, there is provided a device for removing animal excrement from a surface, comprising a cylindrical member adapted to act as a handle, one end of which is tubular and terminates in a collar to which is attached a plurality of outwardly-biased gripping members, a hollow outer member having an outwardly-tapering shape, and adapted to move over the tubular portion of the handle from a first position in which the gripping members are enclosed within the outer member to a second position in which the gripping members are exposed so as to enable them to deploy for use and vice versa, a compression spring incorporated in the tubular portion of the handle and adapted to bear on the outer member so as to urge the outer member from the position at which the gripping members are exposed to that at which they are enclosed within the outer member, means for loading the compression spring as the outer member is moved initially from the position at which the gripping members are enclosed within the outer member to that at which they are exposed and means for releasably retaining the outer member in the position at which the gripping members are exposed.

The present invention retains the advantages of the device disclosed in our earlier application GB 0122664.6 but has the further advantages that the outwardly-tapering shape of the outer member enables a greater volume of excrement to be lifted by the device. Also, the shape of the outer member facilitates its movement of persons of limited strength so as to expose the gripping members and load the return spring.

BRIEF DESCRIPTION OF THE DRAWINGS

The invention will now be described, by way of example, with reference to the accompanying drawings, in which.

DESCRIPTION OF THE PREFERRED EMBODIMENT

Figure 1:
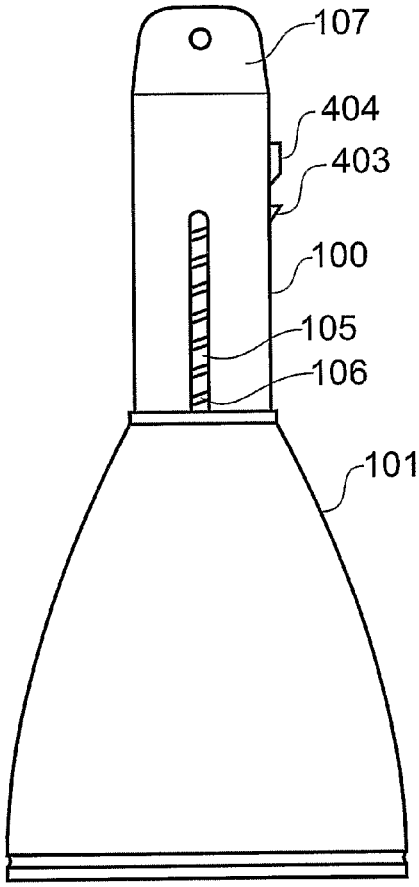
FIG. 1 is a side view of a device embodying the invention for removing animal excrement from a surface.
Figure 2:
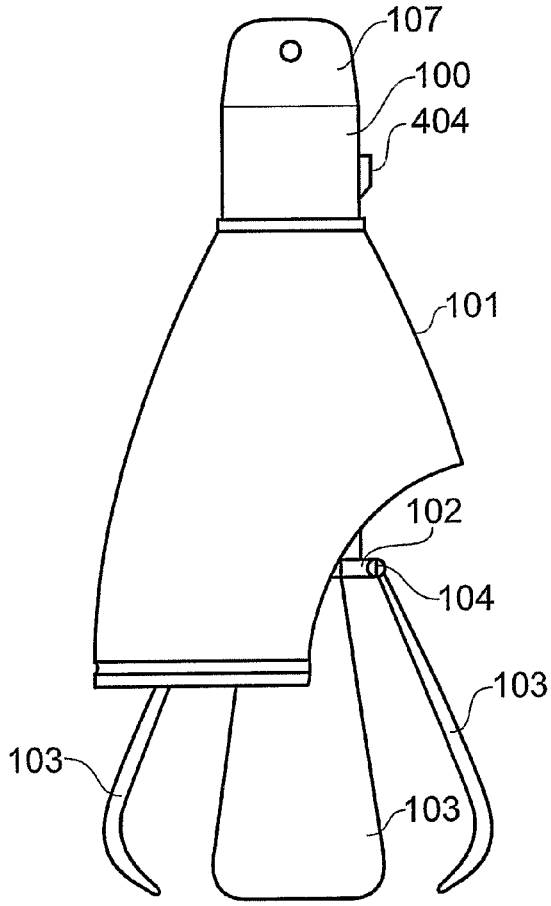
FIG. 2 is a side view of the device shown in FIG. 1 showing the device ready for use.

Referring to the drawings, a device for removing animal excrement from a surface consists of a cylindrical tubular inner member 100 which is adapted to act as a handle, and a conical outer member 101 which is adapted to be movable along the inner member 100. Pivotally attached to a collar 102 at the lower end of the inner member 100, as shown in FIGS. 1 and 2, are four inwardly directed claws 103 which constitute a gripping means to enable animal excrement to be removed from a surface. The claws 103 are outwardly-biased by means of torsion springs 104 of the type known colloquially as hair-pin springs. Other forms of biasing springs, such as leaf springs can be used to bias the claws 103 outwardly, but hair-pin springs are preferred as they can be made to provide a biasing action which is relatively constant over a large angle of deflection.

The collar 102 at the lower end of the inner member 100 acts as a stop to retain the outer member 101 at the lower end of its travel over the inner member 100. The construction of the inner member 100 is such that two diametrically opposed longitudinal slots 105 extend along a lower portion of the inner member 100. The upper ends of the slots 105 provide upper stops for the movement of the outer member 101 along the inner member 100. Positioned within the inner member 100 is a longitudinally extending coil compression spring 106. The spring 106 can be seen through the facing slot 105. As shown in FIG. 4, a portion 401 of the inner member 100 is separated from the rest by means of a U-shaped slit 402 so that it can move relative to the remainder of the inner member 100. The resilience of the material from which the inner member 100 is made enables the portion 401 of the inner member 100 to act as an outwardly-directly leaf spring. The portion 401 of the inner member 100 has two projections 403, 404 on its outer surface. The projection 403 has an upwardly-directed edge which can engage with an internal axially-extending collar 301, shown in FIG. 3, which forms part of the outer member 101, so as to provide a latch to hold the outer member 101 at the upper limit of its travel over the inner member 100. The projection 404 forms a button by means of which the portion 401 of the inner member 100 can be deflected inwardly, so releasing the outer member 101, enabling it to be urged downward by the spring 106. Also within the inner member 100 is a longitudinally extending leaf spring 405 which acts as a friction damper controlling the action of the spring 106. As can be seen from FIG. 4, the inner member 100 is manufactured as two longitudinal sections 406, 407 which fit together to form the inner member 100. Reliefs 408, 409 form the slots 105 in the assembled inner member 100. The sections 406, 407 of the inner member 100 are provided with lugs 410, 411. Lugs 410 engage with an end cap, numbered 107 in FIG. 1, and lugs 411 engage with the collar 102 so as to unite the components of the inner member 100 into a single assembly.

Figure 3:
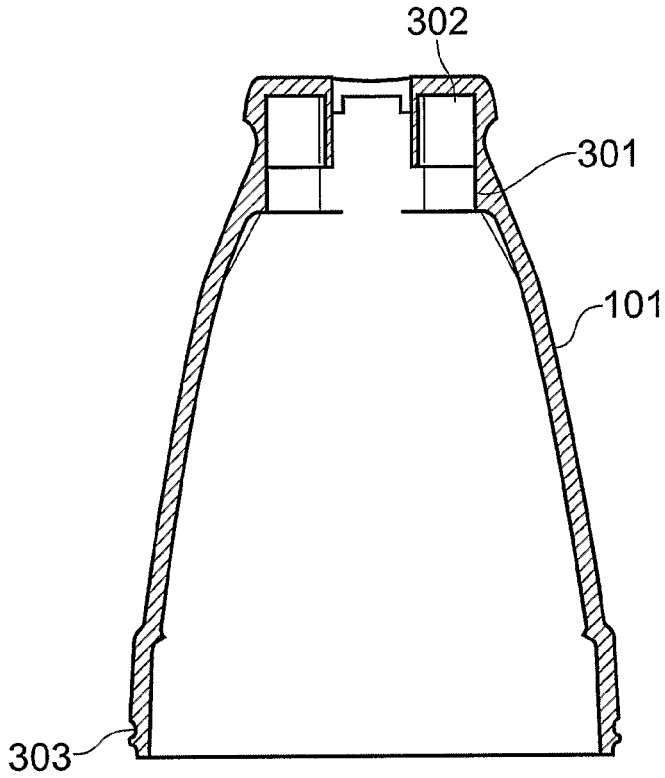
FIG. 3 is a view of an outer member forming part of the device shown in FIG. 1.
Figure 4:
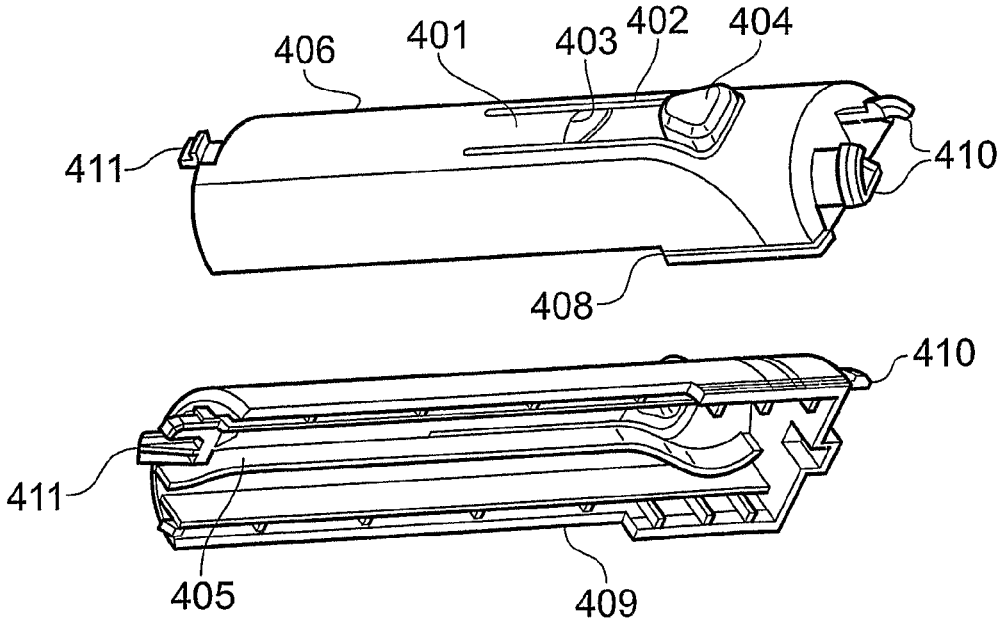
FIG. 4 is an exploded view of an inner member forming part of the device shown in FIG. 1.

Referring to FIG. 3, the outer member 101 has a generally frusto-conical shape at the upper end of which, as shown in the drawing, the internal collar 301 can be seen. Two webs 302 project inwardly from the collar 301. The webs 302 project through the slots 105 in the inner member 100 and provide bearing surfaces for the lower end of the spring 106. A relief 303 runs around the bottom of the outer member 102. A closure cap, not shown in the drawings fits over the lower end of the outer member 101 and snaps into the relief 303.

In use, the outer member 101 is pushed along the inner member 100 until the latch 403 engages. At the same time, the claws 103 are released and opened outwards by the springs 104. A bag (not shown in the drawings) made of an impervious plastics material is placed over the claws 103 and outer member 101 and held in place either by means of a drawstring incorporated in the open neck of the bag, or by means of an elastic band. The bag is pushed into the space between the claws 103, which are then placed so as to enclose the excrement it is desired to remove from a surface and the button 404 is pushed to release the latch 403. The spring 105 urges the outer member 101 downwards causing the claws 103 to close around the excrement, enclosing it within the bag. The neck of the bag is then closed, pushed within the outer member 101 and the closure cap put in place.

The bagged excrement is removed from the device later, for disposal.

The invention claimed is:

1. A device for removing animal excrement from a surface, said device comprising:

a cylindrical inner member adapted to act as a handle, said cylindrical inner member having end portions with one of said end portions being tubular;

a collar attachable to said tubular end portion of said cylindrical inner member;

a plurality of gripping members each being pivotably attachable to said collar;

a torsion spring engagable with each of said gripping members and said collar and positioned to provide an outwardly-biased force on said gripping members respectively;

a hollow outer member adapted to move over said cylindrical inner member from a first position to at least one second position, said first position being in which said gripping members are enclosed within said outer member, said second position being in which said gripping members are exposed from said outer member;

a coil compression spring incorporated in said tubular end portion of said cylindrical inner member, said compression spring being adapted to bear on said outer member so as to urge said outer member from said second position to said first position;

a means for compressing said compression spring as said outer member is moved initially from said first position to said second position; and a trigger means for releasably retaining said outer member in said second position;

wherein a distal end of said outer member has a diameter which is greater than that of a proximal end of said outer member and there is included a damping means adapted to restrain the rate of relaxation of said compression spring when said trigger means is operated so as to release said compression spring from its compressed state.

2. The device as set forth in claim 1, wherein said dampening means further comprising a longitudinally extending leaf spring positionable within said cylindrical inner member, said leaf spring being adapted to bear on coils of said compression spring when said trigger means is operated so as to release said compression spring from its compressed state.

3. The device as set forth in claim 1, wherein said cylindrical inner member further comprising at least two diametrically opposed longitudinal slots defined along a lower portion of said cylindrical inner member.

4. The device as set forth in claim 3, wherein each of said slots of said cylindrical inner member features an upper end adapted to provide an upper stop for the movement of said outer member along said cylindrical inner member, and wherein said collar being adapted to provide a stop to retain said outer member at a lower end of its travel over said cylindrical inner member opposite said upper stop.

5. The device as set forth in claim 3, wherein said outer member has a substantially frusto-conical shape, and wherein said outer member further comprising an upper end, an internal axially-extending collar located in said upper end, and at least two webs projecting inwardly from said internal axially-extending collar.

6. The device as set forth in claim 5, wherein said webs of said outer member being adapted to project through said slots of said cylindrical inner member respectively, said webs being adapted to provide bearing surfaces for a lower end of said compression spring.

7. The device as set forth in claim 5, wherein said cylindrical inner member further comprising at least one outwardly-directed leaf spring portion formed by a U-shaped slit defined in said cylindrical inner member, said U-shaped slit being adapted to allow said leaf spring portion to move relative to the remainder of said cylindrical inner member.

8. The device as set forth in claim 7, wherein said leaf spring portion of said cylindrical inner member further comprising a projection located on an outer surface of said leaf spring portion, said projection has an upwardly-directed edge which is adapted to removably engage with said internal collar of said outer member thereby producing a releasable latch adapted to removably secure said outer member at an upper limit of its travel over said cylindrical inner member.

9. The device as set forth in claim 8, wherein said leaf spring portion of said cylindrical inner member further comprising a button adapted to deflect inwardly said leaf spring portion thereby disengaging said upwardly-directed edge of said projection of said leaf spring portion from said internal collar of said outer member.

10. The device as set forth in claim 3, wherein said cylindrical inner member comprising two longitudinal sections adapted to removably fit together to form said cylindrical inner member, and wherein said diametrically opposed longitudinal slots of said cylindrical inner member are form by reliefs defined in each of said longitudinal sections when said longitudinal sections are assembled to form said cylindrical inner member.

11. The device as set forth in claim 1, wherein said cylindrical inner member further comprising a lug located at said end portion of said cylindrical inner member attachable to said collar, wherein said lug is adapted to removably engage with said collar.

12. The device as set forth in claim 1 further comprising an end cap removably engagable with a lug of said cylindrical inner member located at an end opposite said end portion attachable to said collar.

13. An animal excrement removal device comprising:

a cylindrical inner member adapted to act as a handle, said cylindrical inner member comprising an upper end portion, a lower end portion, at least two diametrically opposed longitudinal slots defined along a portion of said cylindrical inner member, and at least one outwardly-directed leaf spring portion featuring an edge projection on an outer surface thereof;

a collar attachable to said upper end portion of said cylindrical inner member;

a plurality of gripping members each being pivotably attachable to said collar;

a torsion spring engagable with each of said gripping members and said collar and positioned to provide an outwardly-biased force on said gripping members respectively;

a hollow outer member movable over said cylindrical inner member from a first position to at least one second position, said outer member having a substantially frusto-conical shape and comprising an upper end, and an internal axially-extending collar located in said upper end, said first position being in which said gripping members are enclosed within said outer member, said second position being in which said gripping members are exposed from said outer member, said internal axially-extending collar being adapted to receivably engage with said edge projection of said outwardly-directed leaf spring portion of said cylindrical inner; and a compression spring incorporated in said tubular portion of said cylindrical inner member, said compression spring being adapted to bear on said outer member so as to urge said outer member from said second position to said first position.

14. The device as set forth in claim 13, wherein said cylindrical inner member further comprising at least two diametrically opposed longitudinal slots defined along a lower portion of said cylindrical inner member.

15. The device as set forth in claim 14, wherein said cylindrical inner member comprising two longitudinal sections adapted to removably fit together to form said cylindrical inner member, and wherein said diametrically opposed longitudinal slots of said cylindrical inner member are form by reliefs defined in each of said longitudinal sections when said longitudinal sections are assembled to form said cylindrical inner member.

16. The device as set forth in claim 14, wherein each of said slots of said cylindrical inner member features an upper end adapted to provide an upper stop for the movement of said outer member along said cylindrical inner member, and wherein said collar being adapted to provide a stop to retain said outer member at a lower end of its travel over said cylindrical inner member opposite said upper stop.

17. The device as set forth in claim 14, wherein said outer member further comprising at least two webs projecting inwardly from said internal axially-extending collar, wherein said webs of said outer member being adapted to project through said slots of said cylindrical inner member respectively, said webs being adapted to provide bearing surfaces for a lower end of said compression spring.

18. The device as set forth in claim 13, wherein said cylindrical inner member further comprising a longitudinally extending leaf spring positionable within said cylindrical inner member, said leaf spring being adapted to bear on coils of said compression spring and act as a friction damper in relation to the longitudinal movement of said compression spring when it is released from its compressed state.

19. The device as set forth in claim 13, wherein said cylindrical inner member further comprising a lug located at said upper end portion and said lower end portion, said lug of said upper end portion is adapted to removably engage with said collar, said lug of said lower end portion is adapted to removably engage with an end cap.

20. The device as set forth in claim 13, wherein said outwardly-directed leaf spring portion of said cylindrical inner member being formed by a U-shaped slit defined in said cylindrical inner member, said U-shaped slit being adapted to allow said leaf spring portion to move relative to the remainder of said cylindrical inner member, and wherein said leaf spring portion of said cylindrical inner member further comprising a button adapted to deflect inwardly said leaf spring portion thereby disengaging said edge projection of said leaf spring portion from said internal axially-extending collar of said outer member.

* * * * *